United States Patent [19]

Wilson

[11] 4,255,830

[45] Mar. 17, 1981

[54] DETACHABLE PUMP HANDLE FOR LIQUID FUEL APPLIANCES

[76] Inventor: G. Kevin Wilson, Box 147, Sheet Harbour, Halifax County, Nova Scotia, Canada

[21] Appl. No.: 106,388

[22] Filed: Dec. 26, 1979

[51] Int. Cl.[3] ..... B25G 1/00

[52] U.S. Cl. ..... 16/114 R; 16/125; 417/511

[58] Field of Search ..... 16/114 R, 125; 417/510, 417/511; 222/401, 402

[56] References Cited

U.S. PATENT DOCUMENTS

| | | | |
|---|---|---|---|
| 1,228,746 | 6/1917 | Charles | 222/402 |
| 3,361,298 | 1/1968 | Trumble . | |
| 3,384,267 | 5/1968 | Trumble . | |

FOREIGN PATENT DOCUMENTS

| | | | |
|---|---|---|---|
| 19486 | 6/1905 | Sweden | 16/114 R |

*Primary Examiner*—Andrew V. Kundrat

*Attorney, Agent, or Firm*—Cushman, Darby & Cushman

[57] ABSTRACT

There is disclosed a handle for attachment to a pump stem on liquid fuel appliances. The handle detachably connects to the pump stem for easier manipulation during pumping to pressurize fuel in the appliance tank.

2 Claims, 3 Drawing Figures

DETACHABLE PUMP HANDLE FOR LIQUID FUEL APPLIANCES

This invention relates to a device for assisting a person in pressurizing a fuel tank on an appliance such as a lantern or a stove.

Liquid fueled stoves, lamps, etc. are provided with a pumping stem and a head thereon, an air passage extending through the head and the stem into the tank. The fuel is pressurized by linearly pumping the stem and keeping the aperture covered with the thumb during inward pressure of the stem. Such stems and the heads thereon are usually small and are often hard to control during the long pumping sequence. The present invention provides a pumping handle which can be quickly and easily detachably secured to the pump stem to ease the operation of pumping up the appliance.

According to a broad aspect, the invention relates to a detachable pump handle for liquid fuel appliances which are provided with a pumping stem and a head on the stem. The handle comprises a bracket to fit the hand of a person, a shank extending from the bracket and a seat for engaging the stem and head of the pump. The seat comprises a bracket extending from the handle shank for engaging the under side of the stem to draw the same upwardly from the appliance and a resilient pad is provided on the handle shank in juxtaposition to the bracket for engaging the head of the stem and for closing off the air passage therein when the handle is used to push the stem and head inwardly of the appliance.

The invention is illustrated by way of example in the accompanying drawings wherein.

Figure 1:
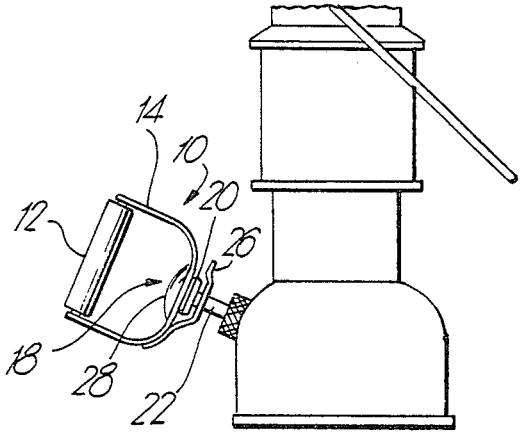
FIG. 1 is an elevation view of the handle attached to the pump stem and showing the appliance in phantom line.
Figure 2:
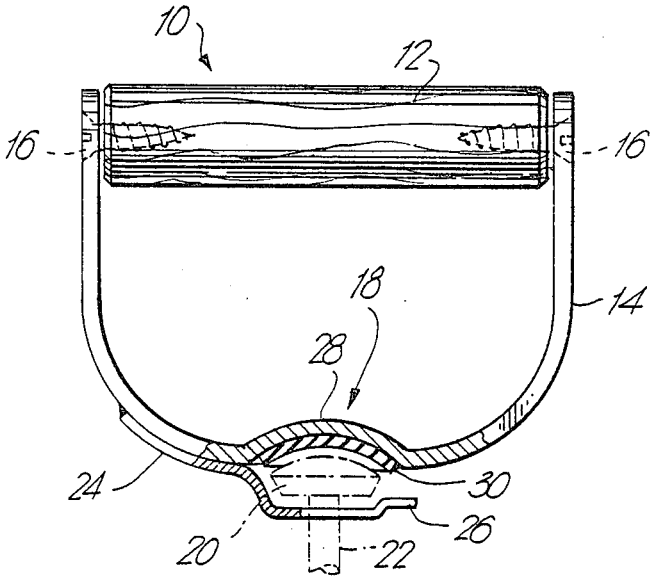
FIG. 2 is a detailed drawing of the handle shown in FIG. 1.
Figure 3:
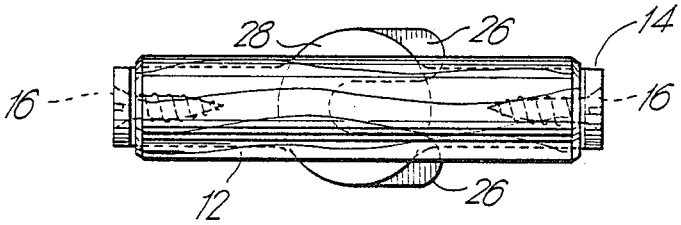
FIG. 3 is a plan view of the handle shown in FIG. 2.

Referring to the drawings, a detachable pump handle 10 includes a bracket or grip 12 to fit the hand of a person using the device and in the embodiment illustrated, a U-shaped shank 14 is secured to the grip by retaining screws 16, the shank extending from the bracket 12 and having at its lower end a seat generally indicated at 18 for engaging the head 20 and stem 22 of the pump. The seat 18 includes a bracket 24 that is secured to the shank 14 and extends outwardly therefrom in the form of a pair of fingers 26 which lie on either side of the stem 22 and which are adapted to engage the underside of the head 20 when the handle 10 is lifted upwardly.

The upper portion of the seat 18 includes a portion 28 of the shank which generally is of the same area as the head of the pump stem 22 and the portion 28 includes a resilient pad 30 which is mounted in juxtaposition to the bracket fingers 26 so that when the handle is used to drive the stem inwardly, the pad will close off the air passage in the stem.

While the embodiment shown has a concave formed seat 18, it will be appreciated that this seat can be contoured to match the surface of the stem head whether it be concave, flat or convex.

In operation, the handle, when raised, draws the stem outwardly of the appliance and allows the stem to inhale air through the air passage. As the handle 10 is lowered, the air within the pump chamber compresses thereby checking the downward motion of the stem until the air intake hole settles on the resilient pad 30. This action seals the air from escaping and forces it into the appliance tank.

I claim:

1. A detachable pump handle for liquid fuel appliances having a pumping stem and head thereon, said handle comprising a bracket to fit the hand of a person; a shank extending from the bracket and a seat for engaging the stem and head of the pump, said seat comprising a bracket extending from the handle shank for engaging the underside of the head and about the stem to draw the same upwardly from the appliance, and a resilient sealing pad on the handle shank in juxtaposition to the bracket for engaging the head of the stem and for closing off the air passage therein when the handle is used to push the stem and head inwardly of the appliance.

2. A pump handle according to claim 1 wherein the resilient pad is contoured to match the surface of the stem head.

* * * * *